US005207170A

United States Patent [19]

Nakahama

[11] Patent Number: 5,207,170

[45] Date of Patent: May 4, 1993

[54] MARINE PROPULSION UNIT CONTROL SYSTEM

[75] Inventor: Ryoji Nakahama, Hamamatsu, Japan

[73] Assignee: Sanshin Kogyo Kabushiki Kaisha, Hamamatsu, Japan

[21] Appl. No.: 705,773

[22] Filed: May 28, 1991

[30] Foreign Application Priority Data

May 30, 1990 [JP] Japan ..... 2-138584

[51] Int. Cl.[5] ..... B63H 25/22

[52] U.S. Cl. ..... 114/150

[58] Field of Search ..... 440/53, 61-63; 114/144 R, 150, 144 E, 144 A; 74/480 B

[56] References Cited

U.S. PATENT DOCUMENTS

| | | | |
|---|---|---|---|
| 2,608,060 | 8/1952 | Smith | 114/150 |
| 2,878,768 | 3/1959 | Warblow | 440/62 |
| 2,901,918 | 9/1959 | Beamer | 114/144 A |
| 3,417,723 | 12/1968 | Akermanis | 74/480 B |

*Primary Examiner*—Jesus D. Sotelo

*Attorney, Agent, or Firm*—Ernest A. Beutler

[57] ABSTRACT

Several embodiments of remote control arrangements for marine watercraft which permit an operator to steer and control an outboard drive of a watercraft from a forward position in the same manner as conventional tiller control. Both linkage and cable operated control systems are disclosed and applications to outboard motors or inboard/outboard drives are illustrated and described.

18 Claims, 5 Drawing Sheets

MARINE PROPULSION UNIT CONTROL SYSTEM

BACKGROUND OF THE INVENTION

This invention relates a marine propulsion unit control system and more particularly to an improved arrangement for controlling a marine outboard drive from a remote location.

Systems have been proposed where marine propulsion units such as outboard motors or the outboard drive portion of an inboard/outboard drive can be controlled from a location remote from the transom. For example, U.S. Pat. No. 4,009,678, issued Mar. 1, 1977 and entitled "Multiple Push-Pull Cable Transmission Apparatus" shows an arrangement wherein the outboard drives mounted on the transom of a watercraft may be steered from the front of a watercraft through a steering wheel. The advantages of permitting the operator to sit forwardly of the transom are obvious. That is, the watercraft may travel more stably if the weight is not all concentrated at the transom. However, when using a steering wheel of the type shown in the aforenoted patent, the operator is not free to employ one of his arms for water activities such as fishing. First of all, the positioning of the steering wheel at the front of the operator obstructs his access and furthermore does not permit him to sit in a manner wherein he may easily handle a fishing pole while, at the same time, steering the outboard drive, as during trolling.

It is, therefore, a principal object of this invention to provide an improved remote control system for a marine outboard drive.

It is a further object of the invention to provide a remote control steering system for a marine outboard drive that permits the operator to steer the watercraft in a conventional fashion and still leave one hand and arm free for activities such as fishing.

SUMMARY OF THE INVENTION

This invention is adapted to be embodied in a watercraft control system for use in a hull having a transom and a marine propulsion united mounted to the rear of the transom for steering movement about a generally vertically extending axis for steering of the hull. Means provide an operator's area within the hull that is spaced forwardly of the transom. A steering control is adapted to be mounted within the hull in an area contiguous to the operator's area other than forwardly thereof and transmission means transmit motion of the steering control into steering movement of the propulsion unit.

DETAILED DESCRIPTION OF THE PREFERRED EMBODIMENTS

Figure 1:
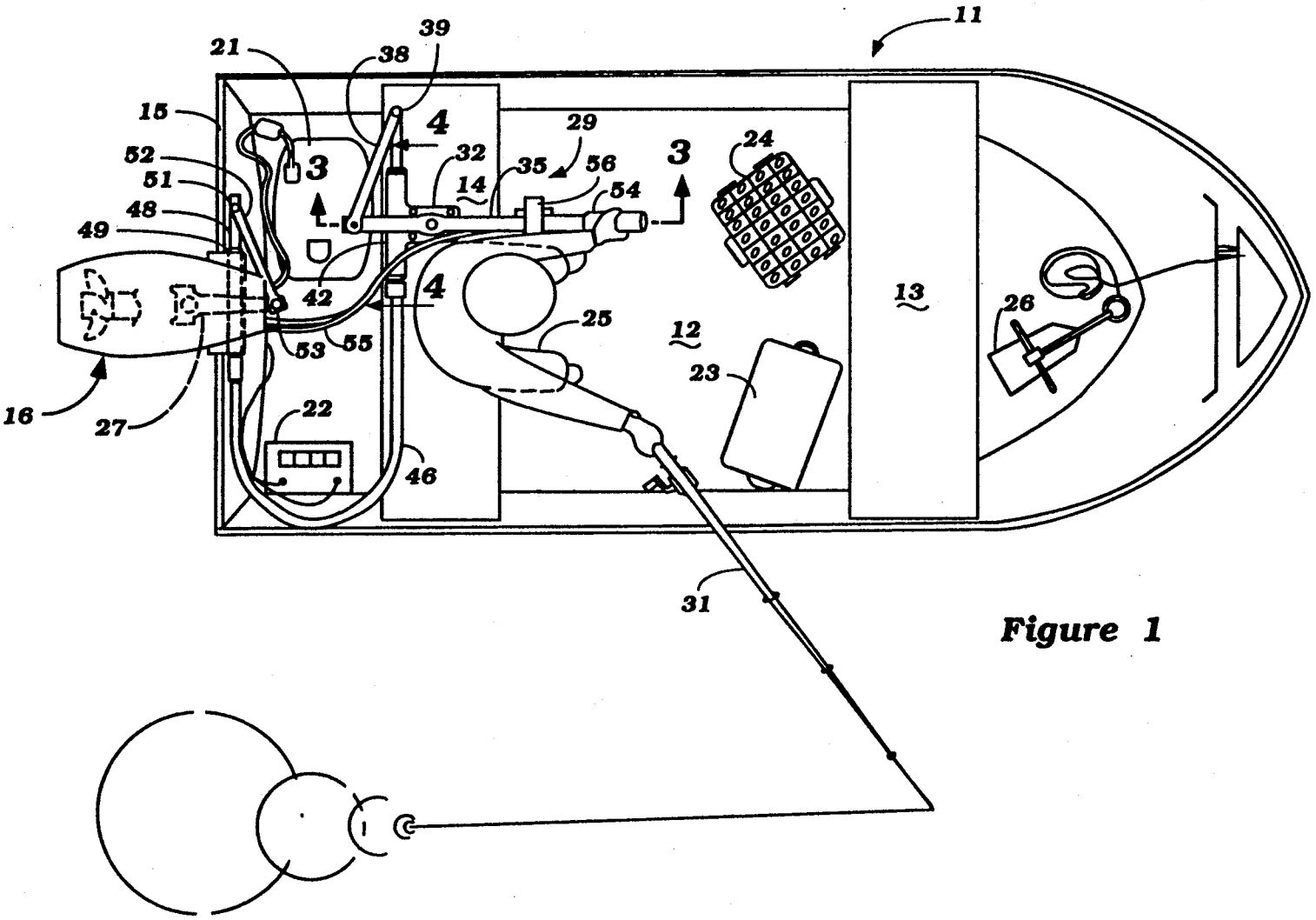
FIG. 1 is a top plan view of a watercraft having a marine propulsion unit control system constructed in accordance with a first embodiment of the invention.
Figure 2:
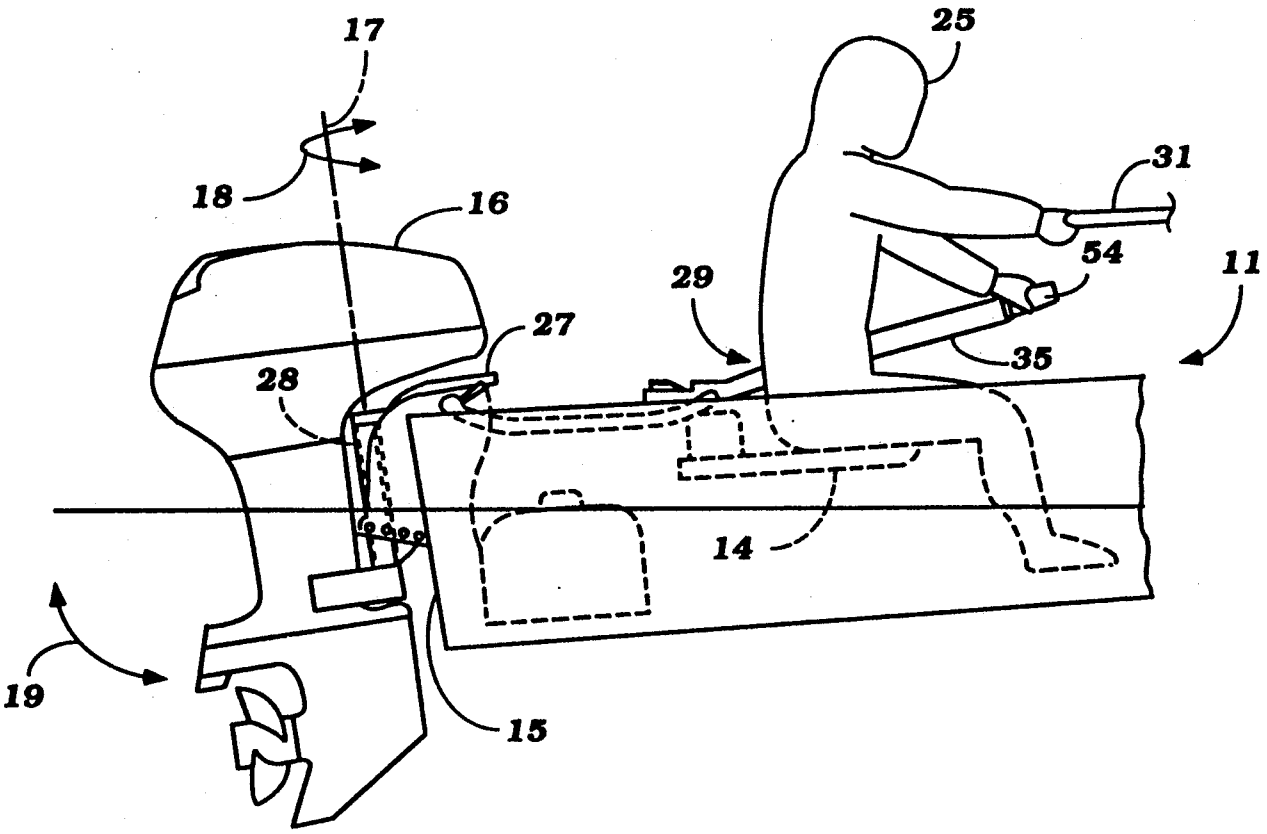
FIG. 2 is a side elevational view of a portion of the watercraft of this embodiment.
Figure 3:
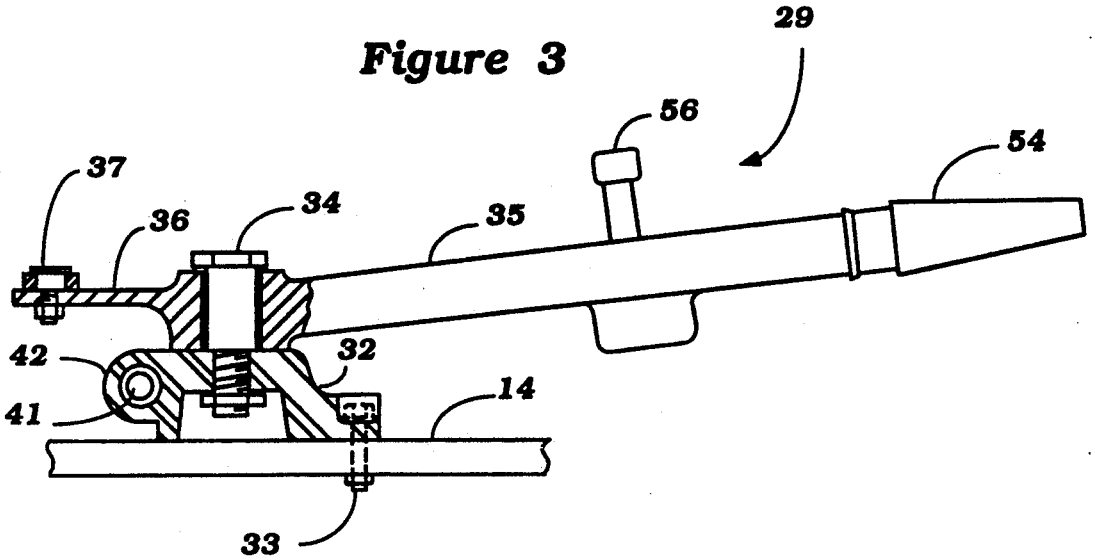
FIG. 3 is an enlarged side elevational view, with a portion broken away, of the propulsion unit and control and is taken generally along the line 3—3 of FIG. 1.
Figure 4:
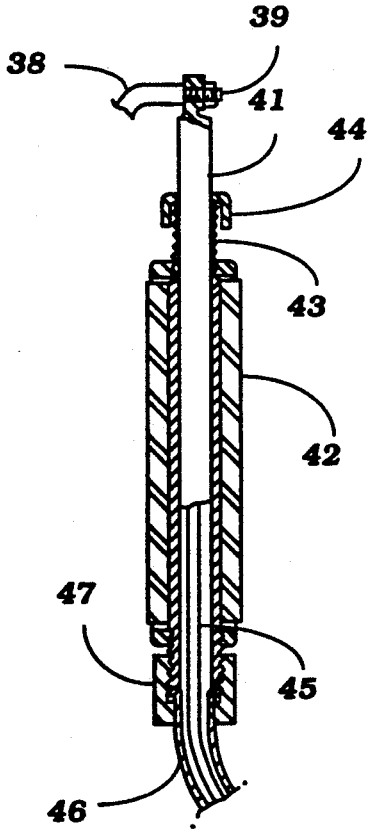
FIG. 4 is a cross-sectional view taken along the line 4—4 of FIG. 1 and shows a portion of the control mechanism.

Referring first to the embodiment of FIGS. 1 through 4, a watercraft of the Dory type is indicated generally by the reference numeral 11. Although the invention is described in conjunction with a Dory type of watercraft, it is to be understood that the invention can be utilized with a wide variety of other types of watercraft. However, the invention has particular utility in conjunction with watercrafts of the type having generally open hulls that provide a substantial rider's area, as shown by the reference numeral 12. The watercraft hull is provided with a front seat 13 and a rear seat 14, both of which are positioned forwardly of the transom 15. A marine outboard drive, an outboard motor 16 in this embodiment, is mounted on the transom 15 in a known manner for steering movement about a steering axis 17 as indicated by the arrow 18 and for tilt and trim movement about a generally horizontally extending axis as indicated by the arrow 19. As will become apparent by reference to the embodiment of FIG. 6, the invention is also adapted to be embodied in watercraft incorporating inboard/outboard drives.

Various equipment for operating the outboard motor 16 may be positioned with the hull of the watercraft 11 and specifically in the rider's area 12. This equipment may include a fuel tank 21 and battery 22 that are positioned between the transom 15 and the rear rider's seat 14.

Other equipment such as a portable cooler 23 and bait box 24 may be positioned in the rider's area 12 between the seats 13 and 14 for access by occupants sitting on either seat. In the illustrated example, a single operator 25 is depicted as being seated on the seat 14.

An anchor 26 may be positioned within the hull at the front of the seat 13 for deployment when desired.

The outboard motor 16 is, as is conventional with outboard motor practice, provided with a steering tiller 27 that is affixed to the upper end of its steering shaft 28 for steering of the outboard motor 16 about the axis 17. In accordance with the invention, a remote steering mechanism, indicated generally by the reference numeral 29 is provided on the seat 14 for operation by the operator 25 so as to permit the operator to steer the outboard motor 16 in a generally conventional fashion and, at the same time, leave one hand free so that the operator may hold a fishing pole 31 in that one hand to fish while trolling. The remote steering control 29 includes a mounting bracket 32 (FIG. 3) that is mounted in a suitable manner on the seat 14, as by threaded fasteners 33. This mounting bracket 32 supports a threaded pivot bolt 34 which, in turn, provides a pivotal support for a steering handle 35.

The steering handle 35 has a portion 36 that extends rearwardly from the pivot bolt 34 and which has a pivotal connection by means of a pivot bolt 37 to one end of a link 38 (FIG. 1). The link 38 has a pivotal connection 39 to a steering control rod 41 that is slidably mounted within a cylindrical boss 42 of the base 32. A coil compression spring 43 acts against the boss 42 and a collar 44 fixed to the rod 41 for urging it in one direction.

The steering rod 41 is connected to one end of a Bowden wire actuator 45 in an appropriate manner and which is contained within a protective sheath 46 also fixed to the boss 42 by means of a fastener 47. The Bowden wire 45 extends through the sheath 46 and is connected to a further steering rod 48 (FIG. 1) that is mounted within a tubular member 49 that is fixed to the transom 15 in a known manner. The steering rod 48 has a pivotal connection 51 to a further link 52. The opposite end of link 52 is pivotally connected to the steering tiller 27 by means of a pivot pin 53. By virtue of the described steering linkage system and particularly the arrangement of the remote control 29, movement of the steering lever 35 by the operator 25 will result in steering movement of the outboard motor 16 in the same direction. Hence, the steering lever 35, in effect, operates as an extension of the tiller 27 but can be placed at the side of the operator 25. Hence, when a single operator is present in the hull 11 he may sit in the center of the watercraft and the watercraft will not list to one side.

In addition to providing for steering of the outboard motor 16, the remote control 29 may provide a twist throttle control 54 which is connected by a further Bowden wire mechanism 55 to the throttle of the outboard motor 16 for controlling its speed. Since these twist type throttle mechanisms are well known, further illustration or description of them is not believed to be necessary to permit those skilled in the art to practice the invention.

In addition, the control lever 35 may also provide a shift control lever 56 that is positioned rearwardly of the twist throttle 54 and which is connected to the transmission of the outboard motor 16 through a suitable wire actuator (not shown) for effecting control of its transmission.

Figure 5:
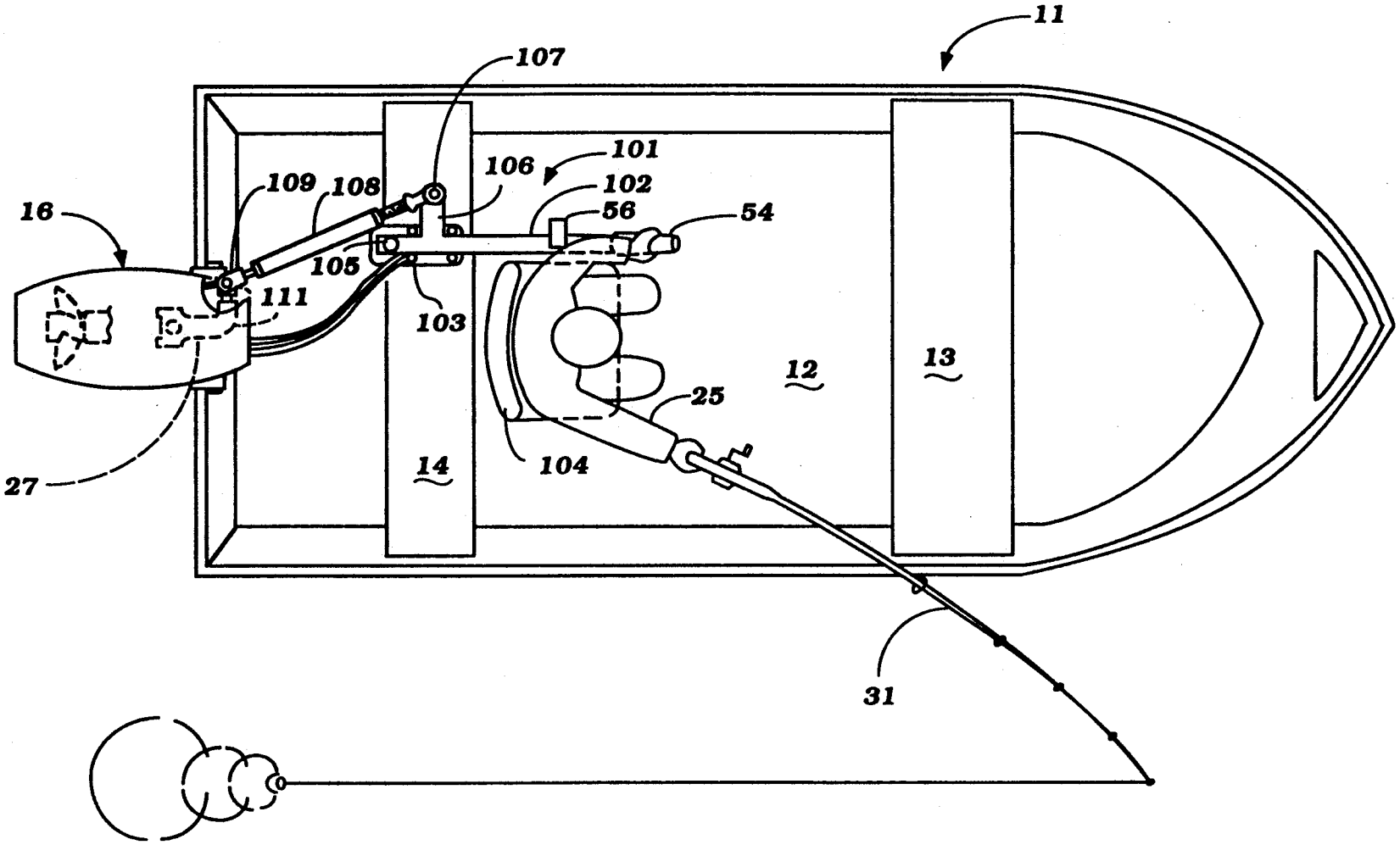
FIG. 5 is a top plan view, in part similar to FIG. 1 and shows another embodiment of the invention.

FIG. 5 shows another embodiment of the invention which is generally similar to the embodiment of FIGS. 1 through 4 but which dispenses with the use of a Bowden wire cable. In this embodiment, the remote control is indicated generally by the reference numeral 101 and includes a steering lever 102 mounted for pivotal movement on a bracket 103 which is affixed to the seat 14. Again, the bracket 103 is mounted to one side of the operator 25 and in this case the operator may be seated on an auxiliary seat 104 positioned forwardly of the rear seat 14. The bracket 103 provides a pivot pin 105 about which the lever 102 pivots. The lever 102 has a belt crank arm 106 that has a pivotal connection 107 to one end of a link 108. The opposite end of the link 108 is pivotally connected by means of a pivot pin 109 to a bent end portion 111 of the tiller 27. Like the previously described embodiment, pivotal movement of the steering lever 102 will accomplish pivotal movement of the outboard motor 16 in the same direction. This embodiment may also employ a twist grip throttle mechanism 54 and shift control lever 56 on the lever 102, as with the previously described embodiment.

Figure 6:
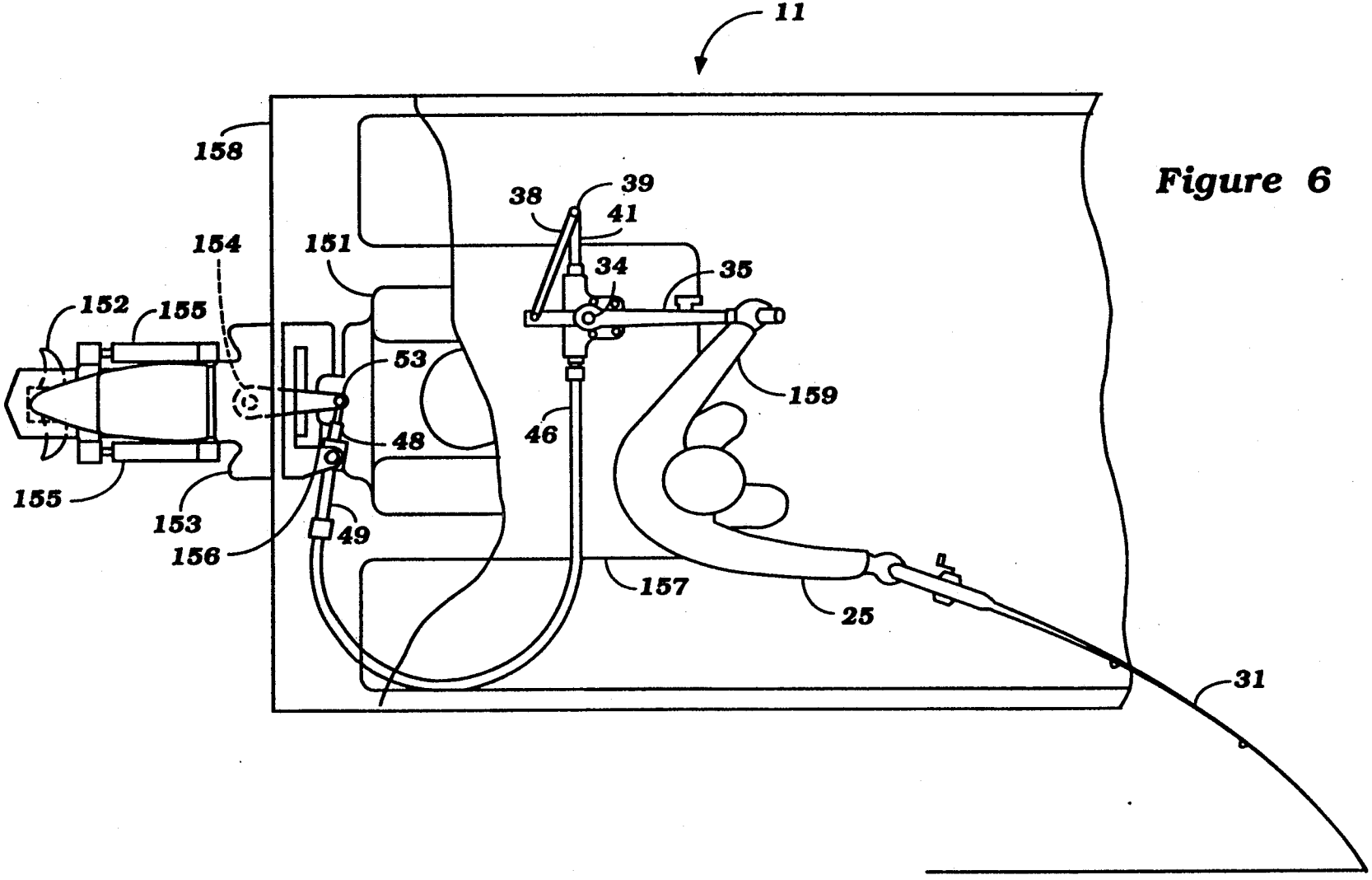
FIG. 6 is a top plan view, in part similar to FIGS. 1 and 5, with a portion broken away, and shows a further embodiment of the invention.

The embodiments of the invention as thus described have applied the invention to outboard motors. As has been noted, however, the invention may be equally as well practiced in conjunction with inboard/outboard drives and FIG. 6 shows such an embodiment. In this embodiment, the watercraft 11 has such a drive that includes an inboard mounted engine 151 which drives a propeller 152 of an outboard drive unit 153 in a known manner. The outboard drive unit is, as is typical with this type of drive, mounted for both steering movement about a vertically extending axis defined by a steering shaft 154 and for tilt and trim movement, controlled by hydraulic cylinders 155 in a known manner. A steering lever 156 is affixed to the steering shaft 154 for steering of the outboard drive 153 and specifically the propeller 152.

In this embodiment, the hull 11 provides a seat 157 forwardly of the transom 158 and upon which an operator 159 may be seated. A steering mechanism of the type shown in FIGS. 1 through 4 is employed in this embodiment and since the steering mechanism is the same as that of FIGS. 1 through 4, its components have been identified by the same reference numerals. Because of the similarity to the previously described embodiment, further description of this embodiment is believed to be unnecessary. However, it is to be understood that a mechanism of the type shown in FIG. 5 may also be employed with inboard/outboard drives in a manner which is believed to be readily apparent to those skilled in the art.

In view of the foregoing, it should be readily apparent that the described propulsion unit control systems permit the operator of a watercraft to be seated a substantial distance from the transom of the watercraft and centrally of the watercraft while still controlling the outboard drive in a conventional manner. Of course, the foregoing description is that of preferred embodiments of the invention and various changes and modifications may be made without departing from the spirit and scope of the invention, as defined by the appended claims.

I claim:

1. A watercraft control for use in a hull having a transom and a marine propulsion unit mounted to the rear of said transom for steering movement about a generally vertically extending axis for steering of said hull, means providing an operator's area within said hull and spaced forwardly of said transom, the improvement comprising a steering control adapted to be mounted as a unit within said hull only in an area contiguous to said operator's area other than forwardly thereof to be operated by an operator's hand and moveable in a horizontal plane, and transmitting means for attachment only to said steering control and said marine propulsion unit for transmitting movement of said steering control into steering movement of said propulsion unit without requiring any other connection with the hull.

2. A watercraft control according to claim 1 wherein the attachment to the marine propulsion unit is to a tiller thereof.

3. A watercraft control according to claim 2 wherein the transmitting means comprises a linkage system.

4. A watercraft control according to claim 3 wherein the steering control comprises a steering lever mounted to a side of the operator's area and offset from the center line of the hull so that a single operator may sit directly on the centerline of the watercraft and steer to one side thereof.

5. A watercraft control according to claim 2 wherein the transmitting means comprises a Bowden wire actuator.

6. A watercraft control according to claim 1 wherein the transmitting means comprises a linkage system.

7. A watercraft control according to claim 1 wherein the transmitting means comprises a Bowden wire actuator.

8. A watercraft control according to claim 1 wherein the steering control comprises a steering lever mounted to a side of the operator's area and is offset from the center line of the hull so that a single operator may sit directly on the center line of the watercraft and steer to one side thereof.

9. A watercraft control for use in a hull having a transom and a marine propulsion unit mounted to the rear of said transom for steering movement about a generally vertically extending axis for steering of said hull, means providing an operator's area within said hull and spaced forwardly of said transom, the improvement comprising a steering control adapted to be mounted as a unit within said hull only in an area contiguous to said operator's area other than forwardly thereof, said steering control comprising a lever pivotal about a vertically extending axis and transmitting means for attachment only to said steering control and said marine propulsion unit for transmitting movement of said steering column into steering movement of said propulsion unit without requiring any other connection with the hull.

10. A watercraft control according to claim 9 wherein the transmitting means transmits pivotal movement of the steering lever into pivotal movement of the propulsion unit.

11. A watercraft for use in a hull having a transom and a marine propulsion unit having a throttle for speed control and a selecting operable transmission mounted to the rear of said transom for steering movement about a generally vertically extending axis for steering of said hull, means providing an operator's area within said hull and spaced forwardly of said transom, the improvement comprising a steering control adapted to be mounted within said hull in an area contiguous to said operator's area other than forwardly thereof, first transmitter means for transmitting movement of said steering control into steering movement of said propulsion unit, a throttle control and a transmission control mounted on said steering control and second transmitter means connecting said throttle control and transmission control to said throttle and said transmission for controlling the speed and transmission of the propulsion unit.

12. A watercraft control according to claim 11 wherein the steering control comprises a lever pivotal about a vertically extending axis.

13. A watercraft control according to claim 12 wherein the first transmitter means transmits pivotal movement of the steering lever into pivotal movement of the propulsion unit.

14. A watercraft control according to claim 13 wherein the first transmitter means is connected to a tiller of the propulsion unit.

15. A watercraft control according to claim 14 wherein the first transmitter means comprises a linkage system.

16. A watercraft control according to claim 15 wherein the steering control comprises a steering lever mounted to a side of the operator's area and offset from the center line of the hull so that a single operator may sit directly on the center line of the watercraft and steer to one side thereof.

17. A watercraft control according to claim 16 wherein the first transmitting means comprises a Bowden wire actuator.

18. A watercraft control according to claim 11 wherein the first transmitter means comprises a Bowden wire actuator.

* * * * *

UNITED STATES PATENT AND TRADEMARK OFFICE

CERTIFICATE OF CORRECTION

PATENT NO. : 5,207,170

DATED : May 4, 1993

INVENTOR(S) : Ryoji Nakahama

It is certified that error appears in the above-indentified patent and that said Letters Patent is hereby corrected as shown below:

Column 4, line 67, Claim 8, delete "is".

Column 5, line 15, Claim 9, "column" should be --control--.

Signed and Sealed this

Fifth Day of April, 1994

Bruce Lehman

*Attest:*

BRUCE LEHMAN

*Attesting Officer*

*Commissioner of Patents and Trademarks*